US007243658B2

(12) United States Patent
Deevi et al.

(10) Patent No.: US 7,243,658 B2
(45) **Date of Patent: *Jul. 17, 2007**

(54) NANOSCALE COMPOSITE CATALYST TO REDUCE CARBON MONOXIDE IN THE MAINSTREAM SMOKE OF A CIGARETTE

(75) Inventors: Sarojini Deevi, Midlothian, VA (US); Kent B. Koller, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 350 days.

This patent is subject to a terminal disclaimer.

(21) Appl. No.: 10/460,210

(22) Filed: Jun. 13, 2003

(65) Prior Publication Data

US 2004/0250825 A1 Dec. 16, 2004

(51) Int. Cl.
*A24B 15/18* (2006.01)

(52) U.S. Cl. ..... 131/334; 131/364

(58) Field of Classification Search ..... 131/364, 131/334, 365, 360

See application file for complete search history.

(56) References Cited

U.S. PATENT DOCUMENTS

| | | | |
|---|---|---|---|
| 3,292,636 | A | 12/1966 | Mays |
| 3,720,214 | A | 3/1973 | Norman et al. |
| 3,807,416 | A | 4/1974 | Hedge et al. |
| 3,931,824 | A | 1/1976 | Miano et al. |
| 4,108,151 | A | 8/1978 | Martin et al. |
| 4,109,663 | A | 8/1978 | Maeda et al. |
| 4,119,104 | A | 10/1978 | Roth |
| 4,182,348 | A | 1/1980 | Seehofer et al. |
| 4,195,645 | A | 4/1980 | Bradley et al. |
| 4,197,861 | A | 4/1980 | Keith |
| 4,199,104 | A | 4/1980 | Houben |
| 4,256,609 | A | 3/1981 | Dale et al. |
| 4,301,035 | A | 11/1981 | Risse |
| 4,317,460 | A | 3/1982 | Dale et al. |
| 4,368,029 | A | 1/1983 | Lacroix |
| 4,450,245 | A | 5/1984 | Adair et al. |
| 4,450,847 | A | 5/1984 | Owens |
| 4,453,553 | A | 6/1984 | Cohn |
| 4,463,030 | A | 7/1984 | Deffeyes et al. |
| 4,489,739 | A | 12/1984 | Mattina et al. |
| 4,524,051 | A | 6/1985 | Wright et al. |
| 4,744,374 | A | 5/1988 | Deffeves et al. |
| 4,763,674 | A | 8/1988 | Lelah |
| 4,855,274 | A | 8/1989 | Upchurch et al. |
| 4,875,910 | A | 10/1989 | Dunnigan et al. |
| 4,940,686 | A | 7/1990 | Tooley et al. |
| 4,956,330 | A | 9/1990 | Elliott et al. |
| 4,957,710 | A | 9/1990 | Nagai et al. |
| 4,991,181 | A | 2/1991 | Upchurch et al. |
| 5,017,357 | A | 5/1991 | Kolts et al. |
| 5,040,551 | A | 8/1991 | Schlatter et al. |
| 5,050,621 | A | 9/1991 | Creighton et al. |
| 5,101,839 | A | 4/1992 | Jakob et al. |
| 5,105,836 | A | 4/1992 | Gentry et al. |
| 5,129,408 | A | 7/1992 | Jakob et al. |
| 5,211,684 | A | 5/1993 | Shannon et al. |
| 5,258,340 | A | 11/1993 | Augustine et al. |
| 5,281,447 | A | 1/1994 | Brady et al. |
| 5,284,166 | A | 2/1994 | Cartwright et al. |
| 5,292,594 | A | 3/1994 | Liburdi et al. |
| 5,322,075 | A | 6/1994 | Deevi et al. |
| 5,386,838 | A | 2/1995 | Quincy et al. |
| 5,388,177 | A | 2/1995 | Ono et al. |
| 5,446,003 | A | 8/1995 | Augustine et al. |
| 5,462,903 | A | 10/1995 | Rousset et al. |
| 5,494,704 | A | 2/1996 | Ackerman |
| 5,503,874 | A | 4/1996 | Ackerman et al. |
| 5,585,020 | A | 12/1996 | Becker et al. |
| 5,591,368 | A | 1/1997 | Fleischhauer et al. |
| 5,598,868 | A | 2/1997 | Jakob et al. |
| 5,620,672 | A | 4/1997 | Galligan et al. |
| 5,671,758 | A | 9/1997 | Rongved |
| 5,702,836 | A | 12/1997 | Ma et al. |
| 5,728,462 | A | 3/1998 | Arino et al. |
| 5,731,257 | A | 3/1998 | Quincy III et al. |
| 5,766,562 | A | 6/1998 | Chattha et al. |
| 5,850,047 | A | 12/1998 | Tani et al. |
| 5,865,959 | A | 2/1999 | Meinzer et al. |
| 5,934,289 | A | 8/1999 | Watkins et al. |
| 5,965,267 | A | 10/1999 | Nola et al. |
| 6,053,176 | A | 4/2000 | Adams et al. |
| 6,074,979 | A | 6/2000 | Hagemeyer et al. |
| 6,083,467 | A | 7/2000 | Takeshima et al. |

(Continued)

FOREIGN PATENT DOCUMENTS

| | | | |
|---|---|---|---|
| EP | 0499402 | A | 8/1992 |

(Continued)

OTHER PUBLICATIONS

International Search Report and Written Opinion for PCT/IB2004/002188 dated Dec. 10, 2004.

International Preliminary Report on Patentability dated Dec. 13, 2005 for PCT/IB2004/002188.

*Primary Examiner*—Dionne W. Mayes

(74) *Attorney, Agent, or Firm*—Buchanan Ingersoll & Rooney PC

(57) ABSTRACT

Cut filler compositions, cigarette paper, cigarette filters, cigarettes, methods for making cigarettes and methods for smoking cigarettes are provided, which involve the use of nanoscale particle composite catalysts capable of acting as a catalyst for the conversion of carbon monoxide to carbon dioxide. The nanoscale composite catalyst comprises metal and/or metal oxide particles supported on nanoscale support particles. The nanoscale composite catalyst can be prepared by forming a mixture by combining nanoscale particles with a colloidal solution, a metal precursor solution with nanoscale particles, or a metal precursor solution with a colloidal solution, and then heat-treating the mixture.

57 Claims, 4 Drawing Sheets

U.S. PATENT DOCUMENTS

| | | | |
|---|---|---|---|
| 6,095,152 | A | 8/2000 | Beven et al. |
| 6,132,694 | A | 10/2000 | Wood et al. |
| 6,138,684 | A | 10/2000 | Yamazaki et al. |
| 6,221,440 | B1 | 4/2001 | Meyer et al. |
| 6,235,677 | B1 | 5/2001 | Manzer et al. |
| 6,251,339 | B1 | 6/2001 | Beane et al. |
| 6,262,129 | B1 | 7/2001 | Murray et al. |
| 6,265,341 | B1 | 7/2001 | Komatsu et al. |
| 6,276,132 | B1 | 8/2001 | Kanesaka et al. |
| 6,286,516 | B1 | 9/2001 | Bowen et al. |
| 6,299,778 | B1 | 10/2001 | Penth et al. |
| 6,315,870 | B1 | 11/2001 | Tabatabaie-Raissi et al. |
| 6,316,377 | B1 | 11/2001 | Fulton et al. |
| 6,346,136 | B1 | 2/2002 | Chen et al. |
| 6,348,431 | B1 | 2/2002 | Even et al. |
| 6,353,037 | B1 | 3/2002 | Thunhorst et al. |
| 6,371,127 | B1 | 4/2002 | Snaidr |
| 6,391,818 | B1 | 5/2002 | Bonsel et al. |
| 6,391,821 | B1 | 5/2002 | Satoh et al. |
| 6,410,765 | B1 | 6/2002 | Wellinghoff et al. |
| 6,857,431 | B2 * | 2/2005 | Deevi et al. ..... 131/334 |
| 2002/0002979 | A1 | 1/2002 | Bowen et al. |
| 2002/0062834 | A1 | 5/2002 | Snaidr et al. |
| 2003/0000538 | A1 | 1/2003 | Bereman |
| 2003/0037792 | A1 | 2/2003 | Snaidr et al. |

FOREIGN PATENT DOCUMENTS

| | | | |
|---|---|---|---|
| GB | 1204353 | A | 9/1970 |
| GB | 2013476 | A | 8/1979 |
| WO | WO 87/06104 | | 10/1987 |
| WO | 98/51401 | A1 | 11/1998 |
| WO | 99/16546 | A1 | 4/1999 |
| WO | 99/21652 | A2 | 5/1999 |
| WO | WO 00/09259 | | 2/2000 |
| WO | WO 00/40104 | | 7/2000 |
| WO | WO 02/24005 | | 3/2002 |
| WO | 03/020058 | A | 3/2003 |
| WO | 03/086112 | A | 10/2003 |

* cited by examiner

NANOSCALE COMPOSITE CATALYST TO REDUCE CARBON MONOXIDE IN THE MAINSTREAM SMOKE OF A CIGARETTE

FIELD OF THE INVENTION

The invention relates generally to methods for reducing constituents such as carbon monoxide in the mainstream smoke of a cigarette during smoking. More specifically, the invention relates to cut filler compositions, cigarettes, methods for making cigarettes and methods for smoking cigarettes, which involve the use of nanoparticle additives capable of reducing the amounts of various constituents in tobacco smoke.

BACKGROUND OF THE INVENTION

In the description that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art.

Smoking articles, such as cigarettes or cigars, produce both mainstream smoke during a puff and sidestream smoke during static burning. One constituent of both mainstream smoke and sidestream smoke is carbon monoxide (CO). The reduction of carbon monoxide in smoke is desirable.

Catalysts, sorbents, and/or oxidants for smoking articles are disclosed in the following: U.S. Pat. No. 6,371,127 issued to Snider et al., U.S. Pat. No. 6,286,516 issued to Bowen et al., U.S. Pat. No. 6,138,684 issued to Yamazaki et al., U.S. Pat. No. 5,671,758 issued to Rongved, U.S. Pat. No. 5,386,838 issued to Quincy, III et al., U.S. Pat. No. 5,211,684 issued to Shannon et al., U.S. Pat. No. 4,744,374 issued to Deffeves et al., U.S. Pat. No. 4,453,553 issued to Cohn, U.S. Pat. No. 4,450,847 issued to Owens, U.S. Pat. No. 4,182,348 issued to Seehofer et al., U.S. Pat. No. 4,108,151 issued to Martin et al., U.S. Pat. No. 3,807,416, and U.S. Pat. No. 3,720,214. Published applications WO 02/24005, WO 87/06104, WO 00/40104 and U.S. Patent Application Publication Nos. 2002/0002979 A1, 2003/0037792 A1 and 2002/0062834 A1 also refer to catalysts, sorbents, and/or oxidants.

Iron and/or iron oxide has been described for use in tobacco products (see e.g., U.S. Pat. Nos. 4,197,861; 4,489,739 and 5,728,462). Iron oxide has been described as a coloring agent (e.g. U.S. Pat. Nos. 4,119,104; 4,195,645; 5,284,166) and as a burn regulator (e.g. U.S. Pat. Nos. 3,931,824; 4,109,663 and 4,195,645) and has been used to improve taste, color and/or appearance (e.g. U.S. Pat. Nos. 6,095,152; 5,598,868; 5,129,408; 5,105,836 and 5,101,839).

Despite the developments to date, there remains a need for improved and more efficient methods and compositions for reducing the amount of carbon monoxide in the mainstream smoke of a smoking article during smoking.

SUMMARY

Tobacco cut filler compositions, cigarette paper, cigarette filter material, cigarettes, methods for making cigarettes and methods for smoking cigarettes that involve the use of nanoscale composite catalysts capable of converting carbon monoxide to carbon dioxide are provided.

One embodiment provides a tobacco cut filler composition comprising tobacco and a nanoscale composite catalyst for the conversion of carbon monoxide to carbon dioxide, wherein the nanoscale composite catalyst comprises nanoscale metal particles and/or nanoscale metal oxide particles supported on nanoscale support particles.

Another embodiment provides a cigarette comprising tobacco cut filler, wherein the cut filler comprises a catalyst capable of converting carbon monoxide to carbon dioxide, wherein the catalyst is in the form of a nanoscale composite catalyst comprising nanoscale metal particles and/or metal oxide particles supported on nanoscale support particles. The cigarette can further comprise cigarette paper and optionally a cigarette filter, wherein the cigarette paper and/or the filter comprises a nanoscale composite catalyst.

Provided are cigarettes that preferably comprise up to about 200 mg of the catalyst per cigarette, and more preferably from about 10 mg to about 100 mg of the catalyst per cigarette. Preferably the nanoscale composite catalyst is added to the tobacco cut filler, cigarette paper, cigarette filter, cigarette and/or cigarette filter material in a catalytically effective amount, i.e., an amount effective to convert at least about 10%, preferably at least about 25% of the carbon monoxide to carbon dioxide.

A further embodiment provides a method of making a cigarette, comprising (i) adding a nanoscale composite catalyst to a tobacco cut filler; (ii) providing the cut filler to a cigarette making machine to form a tobacco column; and (iii) placing a paper wrapper around the tobacco column to form the cigarette.

In a preferred embodiment the nanoscale metal particles and/or metal oxide particles comprise transition, refractory and precious metals such as B, Mg, Al, Si, Ti, Fe, Co, Ni, Cu, Zn, Ge, Zr, Nb, Mo, Ru, Rh, Pd, Ag, Sn, Ce, Hf, Ta, W, Re, Os, Ir, Pt, Au and mixtures thereof, and the nanoscale support comprises nanoscale particles of aluminum oxide, silicon oxide, titanium oxide, iron oxide, cobalt oxide, copper oxide, zirconium oxide cerium oxide, yttrium oxide optionally doped with zirconium, manganese oxide optionally doped with palladium, and mixtures thereof.

According to another preferred embodiment, the nanoscale metal particles and/or nanoscale metal oxide particles comprise Au and the nanoscale support particles comprise silicon oxide, titanium oxide, iron oxide and/or copper oxide. For example, the nanoscale composite catalyst can comprise from about 0.1 to 25 wt. % gold nanoscale particles supported on iron oxide nanoscale particles.

Also provided are methods of forming a cigarette containing a nanoscale composite catalyst. According to one embodiment, the method comprises combining nanoscale metal and/or metal oxide particles and nanoscale support particles in a colloidal solution, increasing the viscosity of the colloidal solution to form an intimate mixture of the nanoscale particles and the colloidal solution, and drying the mixture. According to a further embodiment, the method comprises combining a metal precursor and a solvent to form a metal precursor solution, combining the metal precursor solution with support particles to form a mixture, heating the mixture to a temperature effective to thermally decompose the metal precursor into nanoscale particles, and drying the mixture.

The nanoscale particles and the nanoscale support particles can have an average particle size less than about 100 nm, preferably less than about 50 nm, more preferably less than about 10 nm, and most preferably less than about 7 nm. The nanoscale composite catalyst is preferably carbon free.

The nanoscale support particles can be derived from a colloidal solution and can comprise silicon oxide, titanium oxide, iron oxide and/or copper oxide, where the concentration of colloids in the colloidal solution can be from about 10 to 60 weight percent. The viscosity of the colloidal solution can be increased by changing the pH of the colloidal solution. The step of increasing the viscosity of the colloidal solution can comprise adding a dilute acid or a dilute base to the colloidal solution, such as dilute HCl. According to a preferred method, the viscosity of the colloidal solution is increased to form a gel before the step of heating the mixture. The step of drying the mixture can comprise air-drying or super-critical drying.

According to a further method, the metal precursor is one or more of dionates, oxalates and hydroxides and the metal comprises at least one element selected from B, Mg, Al, Si, Ti, Fe, Co, Ni, Cu, Zn, Ge, Zr, Nb, Mo, Ru, Rh, Pd, Ag, Sn, Ce, Hf, Ta, W, Re, Os, Ir, Pt and Au. The solvent can comprise at least one of distilled water, alcohol, aldehydes, ketones and aromatic hydrocarbons. Preferably, the mixture is heated to a temperature of from about 200 to 400° C. The nanoscale particles are preferably intimately mixed with, or are coated on the nanoscale support particles.

Yet another embodiment provides a method of smoking the cigarette described above, which involves lighting the cigarette to form smoke and drawing the smoke through the cigarette, wherein during the smoking of the cigarette, the catalyst acts as a catalyst for the conversion of carbon monoxide to carbon dioxide.

DETAILED DESCRIPTION OF PREFERRED EMBODIMENTS

Figure 1:
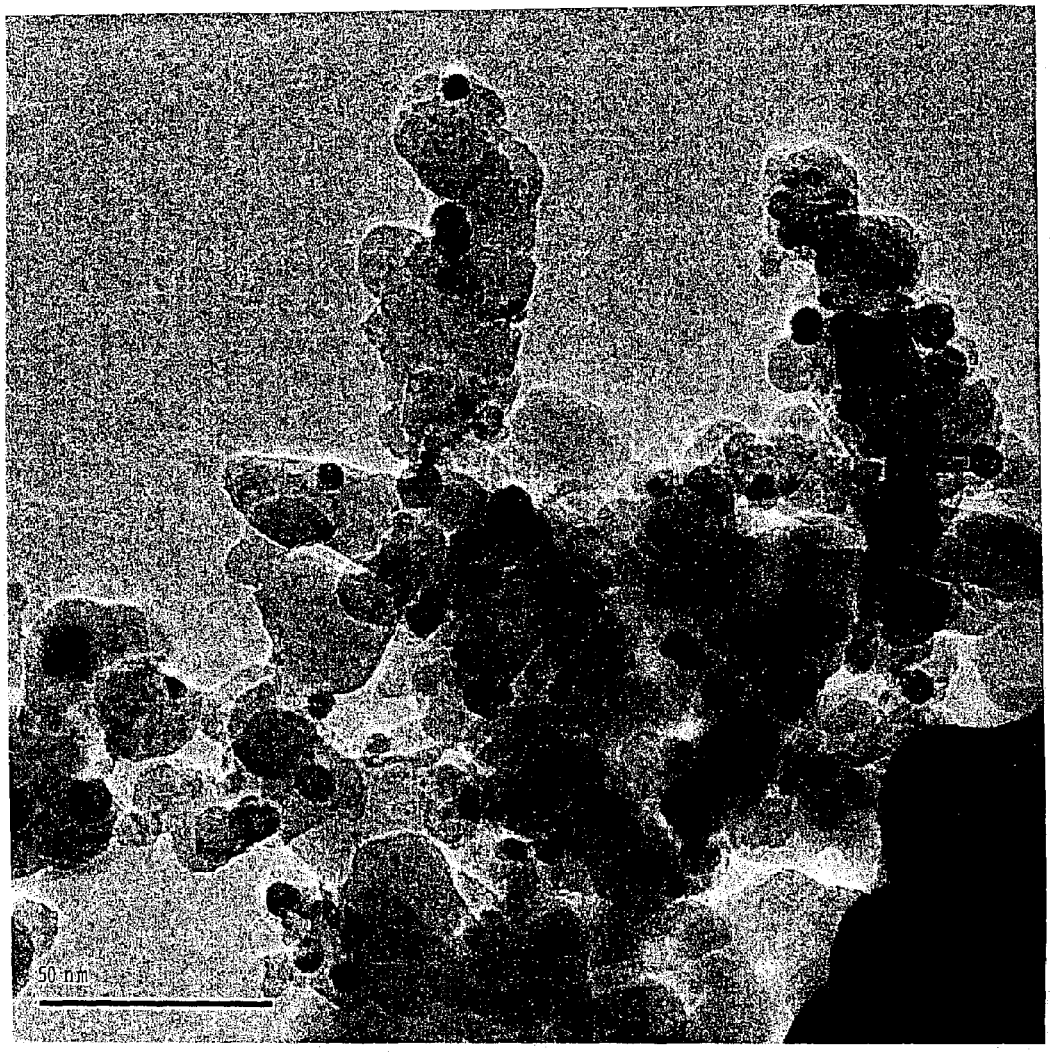
FIGS. 1-4 show TEM images of a nanoscale composite catalyst. The images show nanoscale gold particles supported on a nanoscale iron oxide support.

Provided are tobacco cut filler compositions, cigarette paper, cigarette filter material, cigarettes, methods for making cigarettes and methods for smoking cigarettes that involve the use of nanoscale composite catalysts capable of converting carbon monoxide to carbon dioxide.

"Smoking" of a cigarette means the heating or combustion of the cigarette to form smoke, which can be inhaled. Generally, smoking of a cigarette involves lighting one end of the cigarette and, while the tobacco contained therein undergoes a combustion reaction, drawing the cigarette smoke through the mouth end of the cigarette. The cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 or 5,322,075.

The term "mainstream" smoke refers to the mixture of gases passing down the tobacco rod and issuing through the filter end, i.e. the amount of smoke issuing or drawn from the mouth end of a cigarette during smoking of the cigarette.

In addition to the constituents in the tobacco, the temperature and the oxygen concentration are factors affecting the formation and reaction of carbon monoxide and carbon dioxide. The total amount of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface ($k_a$) and via a surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

During smoking there are three distinct regions in a cigarette: the combustion zone, the pyrolysis/distillation zone, and the condensation/filtration zone. While not wishing to be bound by theory, it is believed that the nanoscale composite catalyst can target the various reactions that occur in different regions of the cigarette during smoking.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. Because oxygen is being consumed in the combustion of tobacco to produce carbon monoxide, carbon dioxide, water vapor, and various organics, the concentration of oxygen is low in the combustion zone. The low oxygen concentrations coupled with the high temperature leads to the reduction of carbon dioxide to carbon monoxide by the carbonized tobacco. In this region, the nanoscale composite catalyst can convert carbon monoxide to carbon dioxide via both catalysis and oxidation mechanism. The combustion zone is highly exothermic and the heat generated is carried to the pyrolysis/distillation zone.

The pyrolysis zone is the region behind the combustion zone, where the temperatures range from about 200° C. to about 600° C. The pyrolysis zone is where most of the carbon monoxide is produced. The major reaction is the pyrolysis (i.e. the thermal degradation) of the tobacco that produces carbon monoxide, carbon dioxide, smoke components, and charcoal using the heat generated in the combustion zone. There is some oxygen present in this region, and thus the nanoscale composite catalyst may act as a catalyst for the oxidation of carbon monoxide to carbon dioxide. The catalytic reaction begins at 150° C. and reaches maximum activity around 300° C.

In the condensation/filtration zone the temperature ranges from ambient to about 150° C. The major process in this zone is the condensation/filtration of the smoke components. Some amount of carbon monoxide and carbon dioxide diffuse out of the cigarette and some oxygen diffuses into the cigarette. The partial pressure of oxygen in the condensation/filtration zone does not generally recover to the atmospheric level.

The nanoscale composite catalyst comprises metal and/or metal oxide nanoscale particles supported on nanoscale support particles. Nanoscale particles are a novel class of materials whose distinguishing feature is that their average grain or other structural domain size is below 100 nanometers. The nanoscale particles can have an average particle size less than about 100 nm, preferably less than about 50 nm, more preferably less than about 10 nm, and most preferably less than about 7 nm. Nanoscale particles have very high surface area to volume ratios, which makes them attractive for catalytic applications. The nanoscale particle size can be measured using transmission electron microscopy (TEM).

The support can comprise inorganic oxide materials such as silica gel, iron oxide, titanium oxide, aluminum oxide or other material. The synergistic combination of catalytically active nanoscale particles with a catalytically active (nanoscale) support can produce a more efficient catalyst. Thus, nanoscale particles advantageously allow for the use of smaller quantities of material as compared with conventional catalysts to catalyze, for example, the oxidation of CO to $CO_2$.

The nanoscale composite catalyst comprises metal and/or metal oxide particles and a support that may be made using any suitable technique, or the constituents can be purchased from a commercial supplier. For instance, MACH I, Inc., King of Prussia, Pa. sells $Fe_2O_3$ nanoscale particles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/ml. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 nm and a surface area of about 40 $m^2/g$. According to a preferred embodiment, nanoscale metal particles, such as nanoscale noble metal particles, can be supported on nanoscale iron oxide particles.

According to one method, commercially available metal and/or metal oxide nanoscale particles such as nanoscale gold, copper, copper-zinc and/or silver particles can be intimately mixed with a dispersion of a support material such as colloidal silica, which can be gelled in the presence of an acid or base and allowed to dry such as by drying in air. Acids and bases that can be used to gel the colloidal mixture include hydrochloric acid, acetic acid, formic acid, nitric acid, ammonium hydroxide, and the like. The colloidal support can be any suitable concentration such as, for example, 10 to 60 wt. %, e.g., a 15 wt. % dispersion or a 40 wt. % dispersion. When an acid containing chlorine is used, preferably the gel is washed in de-ionized water before drying in order to reduce the concentration of chloride ions in the gel.

According to a second method, nanoscale particles can be formed in situ upon heating a mixture of a suitable metal precursor compound and support. By way of example, metal and/or metal oxide precursor compounds such as gold hydroxide, silver pentane dionate, copper (II) pentane dionate, copper oxalate-zinc oxalate, or iron pentane dionate can be dissolved in a suitable solvent such as alcohol and mixed with a support material such as colloidal silica. During or after gelation, the metal precursor-colloidal silica mixture can be heated to a relatively low temperature, for example 200-400° C., wherein thermal decomposition of the metal precursor results in the formation of nanoscale metal and/or metal oxide particles supported on the silica support. In place of colloidal silica, colloidal titania or a colloidal silica-titania mixture can be used as a support.

Alternatively, both the nanoscale support particles and the metal and/or metal oxide nanoscale particles can be formed in situ upon heating a mixture of suitable metal precursor compounds. For example, a metal precursor such as gold hydroxide, silver pentane dionate, copper (II) pentane dionate, copper oxalate-zinc oxalate, or iron pentane dionate can be dissolved in a suitable solvent such as alcohol and mixed with a second metal precursor (e.g., a support precursor) such as titanium pentane dionate, iron pentane dionate, iron oxalate or other oxide precursor. The metal precursor mixture can be heated to a relatively low temperature, for example 200-400° C., wherein thermal decomposition of the metal precursors results in the formation of nanoscale metal and/or metal oxide particles supported on nanoscale oxide support particles.

Molecular organic decomposition (MOD) can be used to prepare nanoscale particles. The MOD process starts with a metal precursor containing the desired metallic element dissolved in a suitable solvent. The process can involve a single metal precursor bearing one or more metallic atoms or the process can involve multiple single metallic precursors that are combined in solution to form a solution mixture. As described above, MOD can be used to prepare nanoscale metal particles and/or nanoscale metal oxide particles, including the support.

The decomposition temperature of the metal precursor is the temperature at which the ligands substantially dissociate (or volatilize) from the metal atoms. During this process the bonds between the ligands and the metal atoms are broken such that the ligands are vaporized or otherwise separated from the metal. Preferably all of the ligand(s) decompose. However, nanoscale particles may also contain carbon obtained from partial decomposition of the organic or inorganic components present in the metal precursor and/or solvent. Preferably the nanoscale particles are essentially carbon free.

The metal precursors used in MOD processing preferably are high purity, non-toxic, and easy to handle and store (with long shelf lives). Desirable physical properties include solubility in solvent systems, compatibility with other precursors for multi-component synthesis, and volatility for low temperature processing.

Nanoscale particles can be obtained from mixtures of metal precursors or from single-source metal precursor molecules in which one or more metallic elements are chemically associated. The desired stoichiometry of the resultant particles can match the stoichiometry of the metal precursor solution.

An aspect of the method described herein for making a nanoscale composite catalyst is that a commercially desirable stoichiometry can be obtained. For example, the desired atomic ratio in the catalyst can be achieved by selecting a metal precursor or mixture of metal precursors having a ratio of first metal atoms to second metal atoms that is equal to the desired atomic ratio.

The metal precursor compounds are preferably metal organic compounds, which have a central main group, transition, lanthanide, or actinide metal atom or atoms bonded to a bridging atom (e.g., N, O, P or S) that is in turn bonded to an organic radical. Examples of the main group metal atom include, but are not limited to, B, Mg, Al, Si, Ti, Fe, Co, Ni, Cu, Zn, Ge, Zr, Nb, Mo, Ru, Rh, Pd, Ag, Sn, Ce, Hf, Ta, W, Re, Os, Ir, Pt and Au. Such compounds may include metal alkoxides, β-diketonates, carboxylates, oxalates, citrates, metal hydrides, thiolates, amides, nitrates, carbonates, cyanates, sulfates, bromides, chlorides, and hydrates thereof. The metal precursor can also be a so-called organometallic compound, wherein a central metal atom is bonded to one or more carbon atoms of an organic group. Aspects of processing with these metal precursors are discussed below.

Precursors for the synthesis of nanoscale oxides are molecules having pre-existing metal-oxygen bonds such as metal alkoxides $M(OR)_n$ or oxoalkoxides $MO(OR)_n$, R=saturated or unsaturated organic group, alkyl or aryl, β-diketonates $M(\beta\text{-diketonate})_n$ (β-diketonate =RCOCH-COR') and metal carboxylates $M(O_2CR)_n$. Metal alkoxides have both good solubility and volatility and are readily applicable to MOD processing. Generally, however, these compounds are highly hygroscopic and require storage under inert atmosphere. In contrast to silicon alkoxides, which are liquids and monomeric, the alkoxides based on most metals are solids. On the other hand, the high reactivity of the metal-alkoxide bond can make these metal precursor materials useful as starting compounds for a variety of heteroleptic species (i.e., species with different types of ligands) such as $M(OR)_{n-x}Z_x$ (Z=β-diketonate or $O_2CR$).

Metal alkoxides $M(OR)_n$ react easily with the protons of a large variety of molecules. This allows easy chemical modification and thus control of stoichiometry by using, for example, organic hydroxy compounds such as alcohols, silanols ($R_3SiOH$), glycols $OH(CH_2)_nOH$, carboxylic and hydroxycarboxylic acids, hydroxyl surfactants, etc.

Fluorinated alkoxides $M(OR_F)_n$ ($R_F$=$CH(CF_3)_2$, $C_6F_5$, . . . ) are readily soluble in organic solvents and less susceptible to hydrolysis than classical alkoxides. These materials can be used as precursors for fluorides, oxides or fluoride-doped oxides such as F-doped tin oxide, which can be used as metal oxide nanoscale particles and/or as a nanoscale support.

Modification of metal alkoxides reduces the number of M-OR bonds available for hydrolysis and thus hydrolytic susceptibility. Thus, it is possible to control the solution chemistry in situ by using, for example, β-diketonates (e.g. acetylacetone) or carboxylic acids (e.g. acetic acid) as modifiers for, or in lieu of, the alkoxide.

Metal β-diketonates $[M(RCOCHCOR')_n]_m$ are attractive precursors for MOD processing because of their volatility and high solubility. Their volatility is governed largely by the bulk of the R and R' groups as well as the nature of the metal, which will determine the degree of association, m, represented in the formula above. Acetylacetonates (R=R'=$CH_3$) are advantageous because they can provide good yields.

Metal β-diketonates are prone to a chelating behavior that can lead to a decrease in the nuclearity of these precursors. These ligands can act as surface capping reagents and polymerization inhibitors. Thus, small particles can be obtained after hydrolysis of $M(OR)_{n-x}$(β-diketonate)$_x$. Acetylacetone can, for instance, stabilize nanoscale colloids. Thus, metal β-diketonate precursors are preferred for preparing nanoscale particles.

Metal carboxylates such as acetates ($M(O_2CMe)_n$) are commercially available as hydrates, which can be rendered anhydrous by heating with acetic anhydride or with 2-methoxyethanol. Many metal carboxylates generally have poor solubility in organic solvents and, because carboxylate ligands act mostly as bridging-chelating ligands, readily form oligomers or polymers. However, 2-ethylhexanoates ($M(O_2CCHEt_nBu)_n$), which are the carboxylates with the smallest number of carbon atoms, are generally soluble in most organic solvents. A large number of carboxylate derivatives are available for aluminum. Nanoscale aluminum-oxygen macromolecules and clusters (alumoxanes) can be used as catalyst materials. For example, formate $Al(O_2CH)_3(H_2O)$ and carboxylate-alumoxanes $[AlO_x(OH)_y(O_2CR)_z]_m$ can be prepared from the inexpensive minerals gibsite or boehmite.

Multicomponent materials can be prepared from mixed metal (hetero-metallic) precursors or, alternatively, from a mixture of single metal (homo-metallic) precursors.

The use of multiple single-metal precursors has the advantage of flexibility in designing precursor rheology as well as product stoichiometry. Hetero-metallic precursors, on the other hand, may offer access to metal systems whose single metal precursors have undesirable solubility, volatility or compatibility.

Mixed-metal species can be obtained via Lewis acid-base reactions or substitution reactions by mixing alkoxides and/or other metal precursors such as acetates, β-diketonates or nitrates. Because the combination reactions are controlled by thermodynamics, however, the stoichiometry of the hetero-compound once isolated may not reflect the composition ratios in the mixture from which it was prepared. On the other hand, most metal alkoxides can be combined to produce hetero-metallic species that are often more soluble than the starting materials.

The solvent(s) used in MOD processing are selected based on a number of criteria including high solubility for the metal precursor compounds; chemical inertness to the metal precursor compounds; rheological compatibility with the deposition technique being used (e.g. the desired viscosity, wettability and/or compatibility with other rheology adjusters); boiling point; vapor pressure and rate of vaporization; and economic factors (e.g. cost, recoverability, toxicity, etc.).

Solvents that may be used in MOD processing include pentanes, hexanes, cyclohexanes, xylenes, ethyl acetates, toluene, benzenes, tetrahydrofuran, acetone, carbon disulfide, dichlorobenzenes, nitrobenzenes, pyridine, methyl alcohol, ethyl alcohol, butyl alcohol, and mineral spirits.

According to another method, nanoscale particles of metals and/or metal oxides can be formed on a nanoscale support, such as an iron oxide support. Suitable precursor compounds for the metal, metal oxide and iron oxide are those that thermally decompose at relatively low temperatures, such as discussed above. According to an embodiment, a metal precursor solution can be combined with an iron oxide support. The support can be commercially available nanoscale particles, such as nanoscale iron oxide particles, or the support can be prepared from a colloidal solution or metal precursor solution as described above.

A metal precursor solution may be contacted with a support in a number of ways. For example, the metal precursor may be dissolved or suspended in a liquid, and the support may be mixed with the liquid having the dispersed or suspended metal precursor. The dissolved or suspended metal precursor can be adsorbed onto a surface of the support or absorbed into the support. The metal precursor may also be deposited onto a surface of the support by removing the liquid, such as by evaporation so that the metal precursor remains on the support. The liquid may be substantially removed from the support during or prior to thermally treating the metal precursor, such as by heating the support at a temperature higher than the boiling point of the liquid or by reducing the pressure of the atmosphere surrounding the support.

Thermal treatment causes decomposition of the metal precursor to dissociate the constituent metal atoms, whereby the metal atoms may combine to form metal and/or metal oxide particles having an atomic ratio approximately equal to the stoichiometric ratio of the metal(s) in the metal precursor solution.

The support or support precursor can be contacted with a metal precursor solution and the contacted support can be heated in the substantial absence of an oxidizing atmosphere. Alternatively, the support or support precursor can be contacted with a metal precursor solution and the contacted support can be heated in the presence of an oxidizing atmosphere and then heated in the substantial absence of an oxidizing atmosphere.

The metal precursor-contacted support is preferably heated to a temperature equal to or greater than the decomposition temperature of the metal precursor. The preferred heating temperature will depend on the particular ligands used as well as on the degradation temperature of the metal(s) and any other desired groups which are to remain. However, the preferred temperature is from about 200° C. to 400° C., for example 300° C. or 350° C. The heating of the metal precursor-contacted support can occur in an oxidizing and/or reducing atmosphere.

Figure 2:
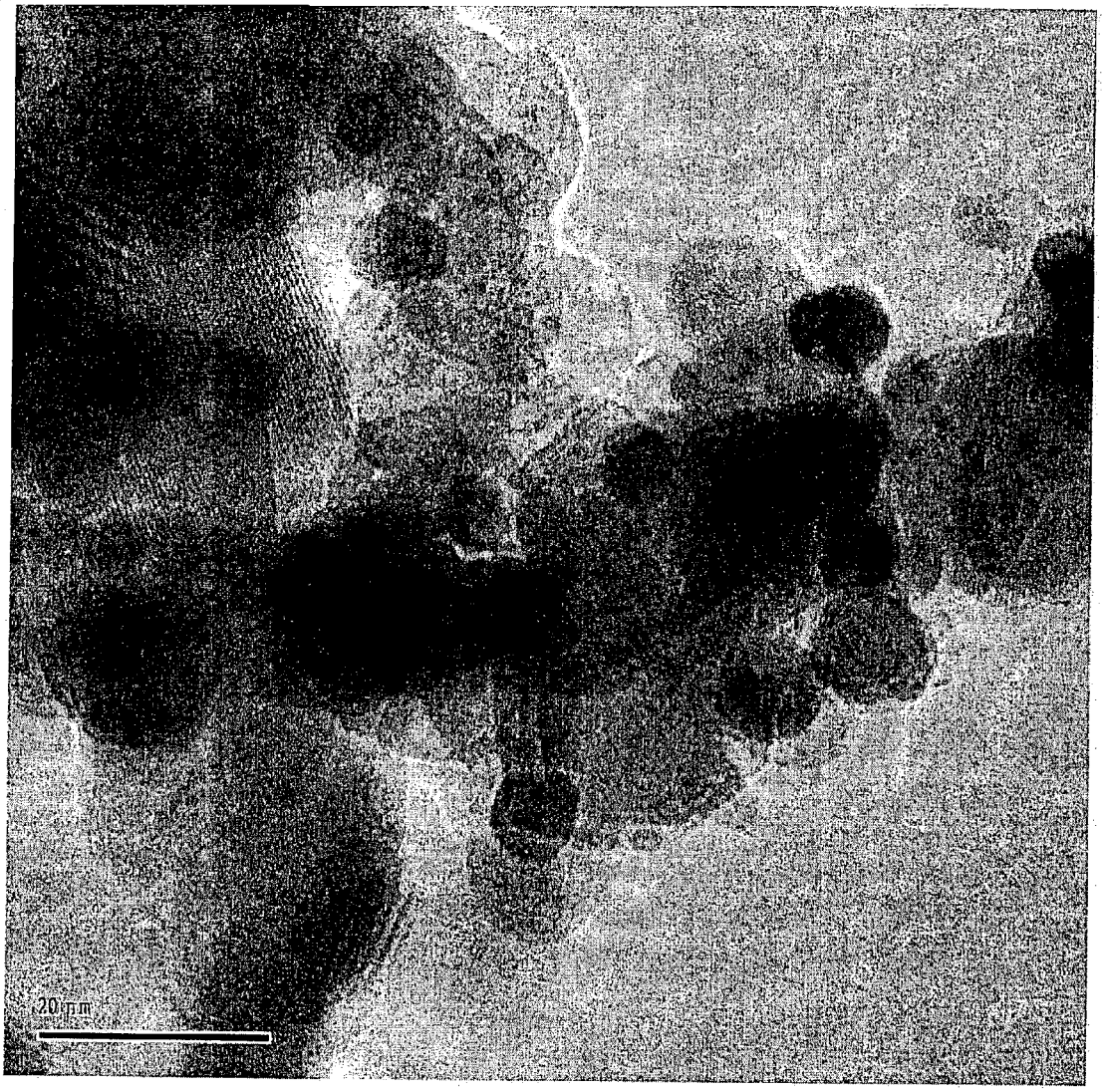
Figure 3:
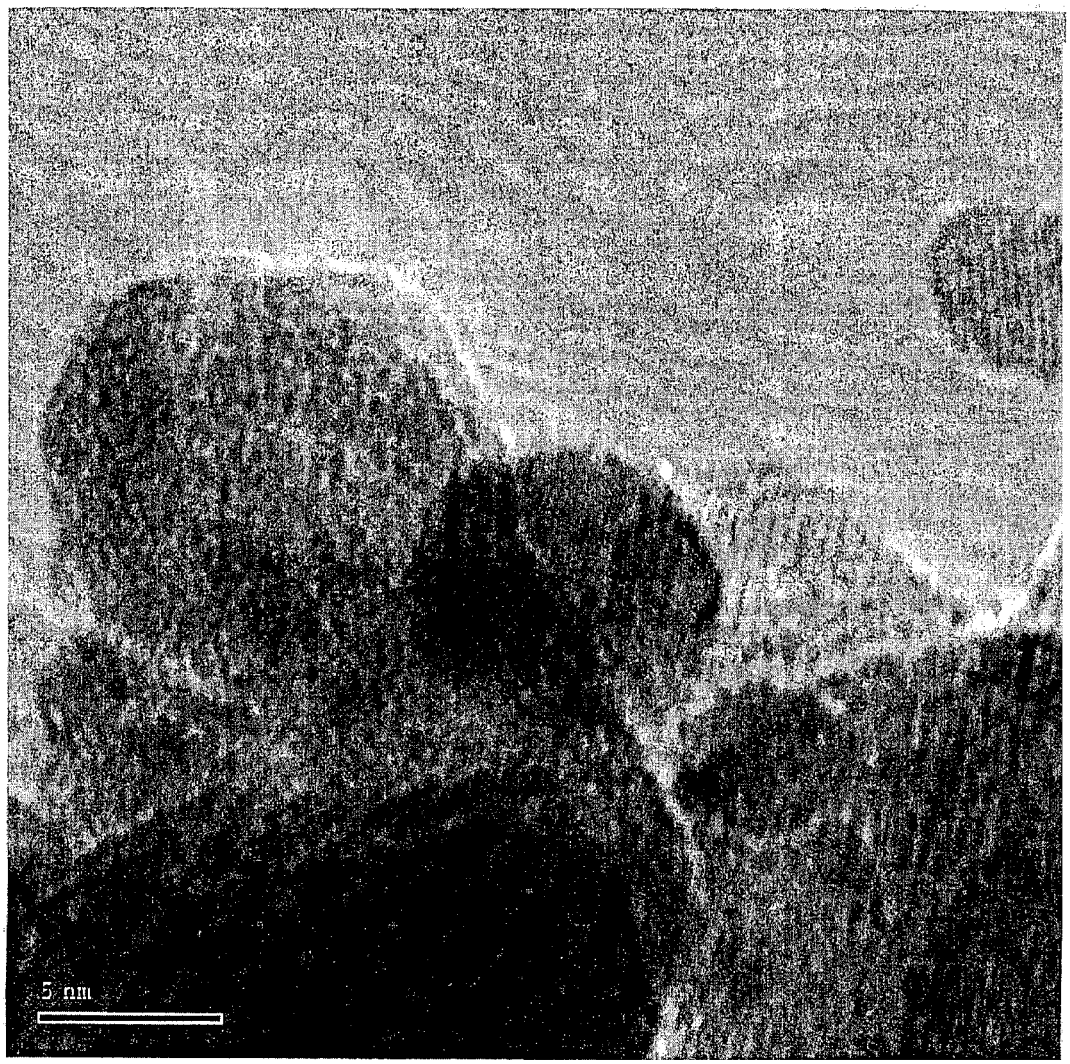
Figure 4:
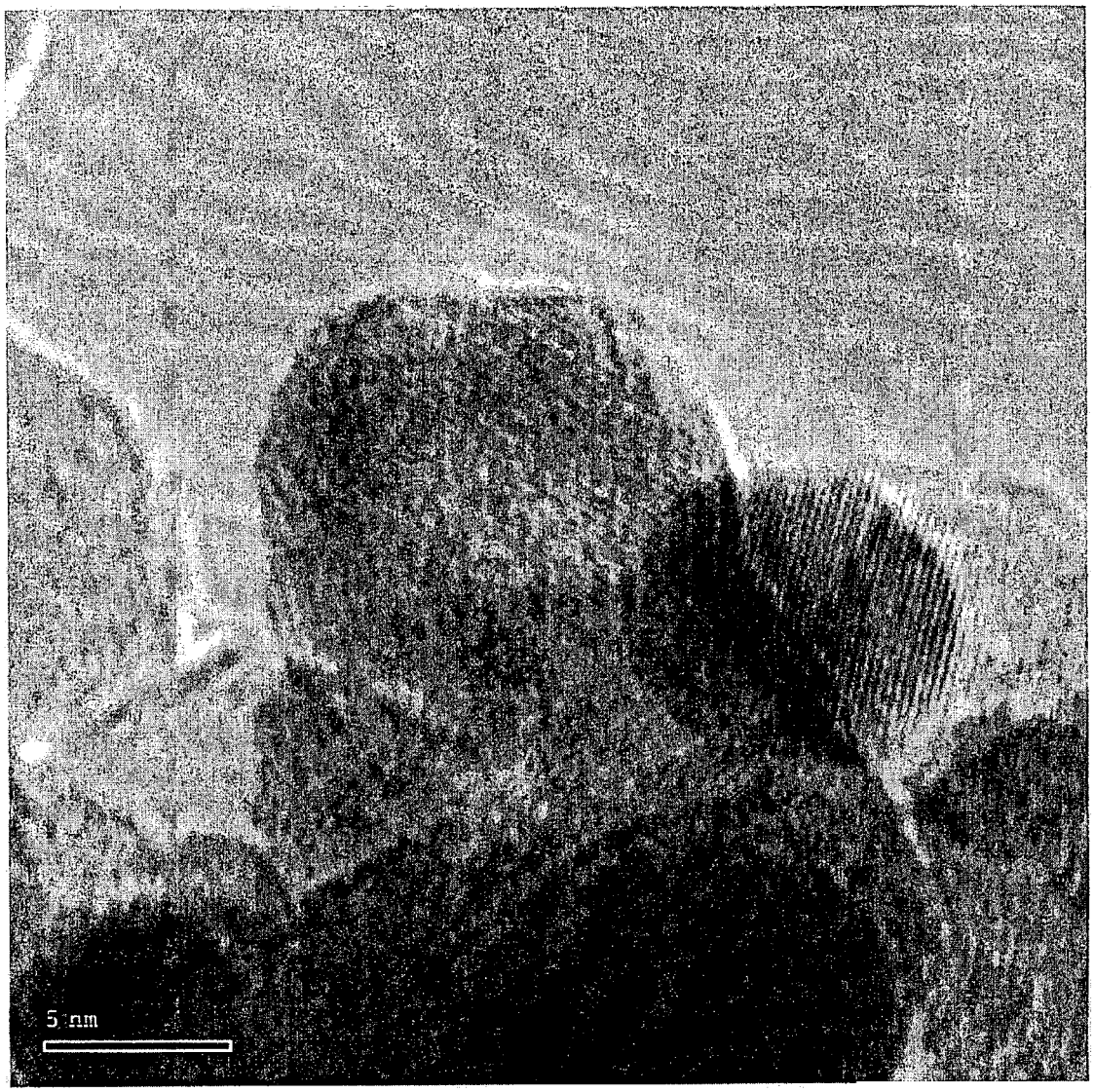

Iron oxide nanoscale particles smaller than about 100 nm can be used as a support for nanoscale gold particles. As an example, iron oxide nanoscale particles having a size as small as 3 nm can be used as the support material. The Au—$Fe_2O_3$ nanoscale composite catalyst can be produced from gold hydroxide that is dissolved in alcohol and mixed with the iron oxide. Decomposition of the hydroxide into nanoscale gold particles, which can be intimately coated/mixed with the iron oxide nanoscale particles, can be caused by heating the mixture to 300 or 400° C. TEM images of nanometer scale gold particles supported on nanometer scale iron oxide are shown in FIGS. 1-4.

In general, a metal precursor and a support can be combined in any suitable ratio to give a desired loading of metal particles on the support. Gold hydroxide and iron oxide can be combined, for example, to produce from about 1% to 25% wt. %, e.g., 2 wt. %, 5 wt. % or 15 wt. %, gold on iron oxide.

Other preferred support materials include $Cu_2O$, CuO, $SiO_2$, $TiO_2$, CoO, ZrO, $CeO_2$, $Ce_2O_3$, or $Al_2O_3$, or doped metal oxides such as $Y_2O_3$ optionally doped with zirconium, $Mn_2O_3$ optionally doped with palladium, and mixtures thereof. The support may include substantially any material which, when heated to a temperature at which a metal precursor is converted to a metal and/or metal oxide on the surface thereof, does not melt, vaporize completely, or otherwise become incapable of supporting nanoscale particles.

During the conversion of CO to $CO_2$, the nanoscale composite catalyst may become reduced. For example, $Fe_2O_3$, which may comprise the support or particles dispersed on a support, may be reduced to $Fe_3O_4$ or FeO during the reaction of CO to $CO_2$.

Iron oxide is a preferred constituent in the composite because it has a dual function as a CO catalyst in the presence of oxygen and as a CO oxidant for the direct oxidation of CO in the absence of oxygen. A catalyst that can also be used as an oxidant is especially useful for certain applications, such as within a burning cigarette where the partial pressure of oxygen can be very low.

A catalyst is capable of affecting the rate of a chemical reaction, e.g., increasing the rate of oxidation of carbon monoxide to carbon dioxide and/or increasing the rate of reduction of nitric oxide to nitrogen without participating as a reactant or product of the reaction. An oxidant is capable of oxidizing a reactant, e.g., by donating oxygen to the reactant, such that the oxidant itself is reduced.

The nanoscale composite catalysts will preferably be distributed throughout the tobacco rod portion of a cigarette. By providing the nanoscale composite catalysts throughout the tobacco rod, it is possible to reduce the amount of carbon monoxide drawn through the cigarette, and particularly at both the combustion region and in the pyrolysis zone.

The nanoscale composite catalysts, as described above, may be provided along the length of a tobacco rod by distributing the nanoscale composite catalysts on the tobacco or incorporating them into the cut filler tobacco using any suitable method. The nanoscale composite catalysts can also be incorporated in cigarette filter material that is used to make a cigarette filter. The nanoscale composite catalysts may be provided in the form of a powder or in a solvent in the form of a dispersion. Nanoscale composite catalysts in the form of a dry powder can be dusted on cut filler tobacco and/or cigarette filter material. Nanoscale composite catalysts may also be present in the form of a dispersion and sprayed on the cut filler tobacco, cigarette paper and/or cigarette filter material. The nanoscale composite catalyst may also be added to the cut filler tobacco stock supplied to the cigarette making machine or added to a tobacco column prior to wrapping cigarette paper around the tobacco column. The catalysts may be added to paper stock of a cigarette papermaking machine or to cigarette filter material during or after processing of the cigarette filter material (e.g., during the manufacture of the cigarette filter material or during the manufacture of a cigarette filter comprising the cigarette filter material).

The step of heating a mixture comprising a metal precursor solution to a temperature effective to thermally decompose the metal precursor into nanoscale particles is preferably performed prior to adding the nanoscale composite catalyst to the cigarette.

The amount of the nanoscale composite catalyst can be selected such that the amount of carbon monoxide in mainstream smoke is reduced during smoking of a cigarette. Preferably, the amount of the nanoscale composite catalyst will be a catalytically effective amount, e.g., from about a few milligrams, for example, 5 mg/cigarette, to about 200 mg/cigarette. More preferably, the amount of nanoscale composite catalyst will be from about 10 mg/cigarette to about 100 mg/cigarette. The nanoscale composite catalyst can be added to the tobacco cut filler and/or cigarette filter in an amount effective to convert at least about 10%, preferably at least about 25% of the carbon monoxide to carbon dioxide.

One embodiment provides a cut filler composition comprising tobacco and at least one catalyst that is capable of converting carbon monoxide to carbon dioxide, where the catalyst is in the form of a nanoscale composite catalyst.

Any suitable tobacco mixture may be used for the cut filler. Examples of suitable types of tobacco materials include flue-cured, Burley, Md. or Oriental tobaccos, the rare or specialty tobaccos, and blends thereof. The tobacco material can be provided in the form of tobacco lamina, processed tobacco materials such as volume expanded or puffed tobacco, processed tobacco stems such as cut-rolled or cut-puffed stems, reconstituted tobacco materials, or blends thereof. The tobacco can also include tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, combustion modifying agents, coloring agents, binders, etc.) known in the art.

Another embodiment provides a cigarette comprising a tobacco rod, wherein the tobacco rod comprises tobacco cut filler having at least one nanoscale composite catalyst, as described above, which is capable of acting as a catalyst for the conversion of carbon monoxide to carbon dioxide. A further embodiment provides a method of making a cigarette, comprising (i) adding a nanoscale composite catalyst to a tobacco cut filler; (ii) providing the cut filler to a cigarette making machine to form a tobacco column; and (iii) placing a paper wrapper around the tobacco column to form the cigarette.

Techniques for cigarette manufacture are known in the art. Any conventional or modified cigarette making technique may be used to incorporate the nanoscale composite catalysts. The resulting cigarettes can be manufactured to any known specifications using standard or modified cigarette making techniques and equipment. Typically, the cut filler composition is optionally combined with other cigarette additives, and provided to a cigarette making machine to produce a tobacco rod, which is then wrapped in cigarette paper, and optionally tipped with filters.

Cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm, and preferably around 25 mm. The tobacco packing density is typically between the range of about 100 mg/cm$^3$ to about 300 mg/cm$^3$, and preferably 150 mg/cm$^3$ to about 275 mg/cm$^3$.

Yet another embodiment provides a method of smoking the cigarette described above, which involves lighting the cigarette to form smoke and drawing the smoke through the cigarette, wherein during the smoking of the cigarette, the catalyst acts as a catalyst for the conversion of carbon monoxide to carbon dioxide.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

What is claimed is:

1. A cut filler composition comprising tobacco and a nanoscale composite catalyst for the conversion of carbon monoxide to carbon dioxide, wherein the nanoscale composite catalyst comprises nanoscale metal particles and/or nanoscale metal oxide particles supported on nanoscale support particles, wherein the nanoscale metal particles and/or nanoscale metal oxide particles have an average particle size from about 3 nm to less than about 100 nm and comprise an element selected from the group consisting of B, Mg, Al, Si, Ti, Fe, Co, Ni, Zn, Ge, Zr, Nb, Mo, Ru, Rh, Pd, Ag, Sn, Hf, Ta, W, Re, Os, Ir, Pt, Au and mixtures thereof.

2. The cut filler composition of claim 1, wherein the nanoscale metal particles and/or the nanoscale metal oxide particles contact one or more surfaces of the nanoscale support particles.

3. The cut filler composition of claim 1, wherein the nanoscale support particles comprise an oxide selected from the group consisting of aluminum oxide, silicon oxide, titanium oxide, iron oxide, cobalt oxide, copper oxide, zirconium oxide, cerium oxide, yttrium oxide optionally doped with zirconium, manganese oxide optionally doped with palladium, and mixtures thereof.

4. The cut filler composition of claim 1, wherein the nanoscale support particles are derived from a colloidal solution.

5. The cut filler composition of claim 1, wherein the nanoscale metal particles and/or nanoscale metal oxide particles comprise gold and the nanoscale support particles comprise an oxide selected from the group consisting of silicon oxide, titanium oxide, iron oxide, copper oxide and mixtures thereof.

6. The cut filler composition of claim 1, wherein the nanoscale metal particles and/or nanoscale metal oxide particles comprise gold and the nanoscale support particles comprise iron oxide.

7. The cut filler composition of claim 1, wherein the nanoscale composite catalyst comprises from about 0.1 to 25 wt. % gold nanoscale particles supported on iron oxide nanoscale support particles.

8. The cut filler composition of claim 1, wherein the nanoscale support particles and the nanoscale metal and/or metal oxide particles have an average particle size from about 3 nm to less than about 50 nm.

9. The cut filler composition of claim 1, wherein the nanoscale support particles and the nanoscale metal and/or metal oxide particles have an average particle size from about 3 nm to less than about 10 nm.

10. The cut filler composition of claim 1, wherein the nanoscale composite catalyst is essentially carbon free.

11. The cut filler composition of claim 1, wherein the cut filler comprises the nanoscale composite catalyst in an amount effective to convert at least about 10% of the carbon monoxide to carbon dioxide.

12. A cigarette comprising cut tobacco filler, cigarette paper and cigarette filter, wherein the cut filler, cigarette paper and/or cigarette filter comprise a catalyst capable of converting carbon monoxide to carbon dioxide, wherein the catalyst is in the form of a nanoscale composite catalyst comprising nanoscale metal particles and/or nanoscale metal oxide particles supported on nanoscale support particles, wherein the nanoscale metal particles and/or nanoscale metal oxide particles have an average particle size from about 3 nm to less than about 100 nm and comprise an element selected from the group consisting of B, Mg, Al, Si, Ti, Fe, Co, Ni, Zn, Ge, Zr, Nb, Mo, Ru, Rh, Pd, Ag, Sn, Hf, Ta, W, Re, Os, Ir, Pt, Au and mixtures thereof.

13. The cigarette of claim 12, wherein the nanoscale metal particles and/or the nanoscale metal oxide particles contact one or more surfaces of the nanoscale support particles.

14. The cigarette of claim 12, wherein the nanoscale support particles comprise an oxide selected from the group consisting of aluminum oxide, silicon oxide, titanium oxide, iron oxide, cobalt oxide, copper oxide, zirconium oxide, cerium oxide, yttrium oxide optionally doped with zirconium, manganese oxide optionally doped with palladium, and mixtures thereof.

15. The cigarette of claim 12, wherein the nanoscale support particles are derived from a colloidal solution.

16. The cigarette of claim 12, wherein the nanoscale metal particles and/or nanoscale metal oxide particles comprise gold and the nanoscale support particles comprise an oxide selected from the group consisting of silicon oxide, titanium oxide, iron oxide, copper oxide and mixtures thereof.

17. The cigarette of claim 12, wherein the nanoscale metal particles and/or nanoscale metal oxide particles comprise gold and the nanoscale support particles comprise iron oxide.

18. The cigarette of claim 12, wherein the nanoscale composite catalyst comprises from about 0.1 to 25 wt. % gold nanoscale particles supported on iron oxide nanoscale support particles.

19. The cigarette of claim 12, wherein the nanoscale support particles and the nanoscale metal and/or metal oxide particles have an average particle size from about 3 nm to less than about 50 nm.

20. The cigarette of claim 12, wherein the nanoscale support particles and the nanoscale metal and/or metal oxide particles have an average particle size from about 3 nm to less than about 10 nm.

21. The cigarette of claim 12, wherein the nanoscale composite catalyst is essentially carbon free.

22. The cigarette of claim 12, wherein the cut filler comprises the nanoscale composite catalyst in an amount effective to convert at least about 10% of the carbon monoxide to carbon dioxide.

23. The cigarette of claim 12, wherein the cigarette comprises from about 5 mg of the nanoscale composite catalyst per cigarette to about 200 mg of the nanoscale composite catalyst per cigarette.

24. The cigarette of claim 12, wherein the cigarette comprises from about 10 mg of the nanoscale composite catalyst per cigarette to about 100 mg of the nanoscale composite catalyst per cigarette.

25. The cigarette of claim 12, wherein the catalyst comprises gold nanoscale particles supported on nanoscale iron oxide support particles and the catalyst is incorporated in the cigarette filter.

26. A method of making a cigarette, comprising:

(i) incorporating a nanoscale composite catalyst in tobacco cut filler, cigarette paper and/or cigarette filter;

(ii) providing the cut filler to a cigarette making machine to form a tobacco column;

(iii) placing a paper wrapper around the tobacco column to form a tobacco rod; and (iv) attaching the cigarette filter to the tobacco rod to form the cigarette, wherein the nanoscale composite catalyst comprises nanoscale support particles and nanoscale metal particles and/or nanoscale metal oxide particles on at least one of the nanoscale support particles, wherein the nanoscale metal particles and/or nanoscale metal oxide particles comprise an element selected from the group consisting of B, Mg, Al, Si, Ti, Fe, Go, Ni, Zn, Ge, Zr, Nb, Mo, Ru, Rh, Pd, Ag, Sn, Hf, Ta, W, Re, Os, Ir, Pt, Au and mixtures thereof.

27. The method of claim 26, wherein the nanoscale metal particles and/or the nanoscale metal oxide particles contact one or more surfaces of the nanoscale support particles.

28. The method of claim 26, comprising combining nanoscale metal and/or metal oxide particles and nanoscale support particles comprising an oxide selected from the group consisting of aluminum oxide, silicon oxide, titanium oxide, iron oxide, cobalt oxide, copper oxide, zirconium oxide, cerium oxide, yttrium oxide optionally doped with zirconium, manganese oxide optionally doped with palladium, and mixtures thereof to form the nanoscale composite catalyst.

29. The method of claim 26, comprising combining nanoscale metal particles and/or nanoscale metal oxide particles comprising gold and nanoscale support particles comprising an oxide selected from the group consisting of silicon oxide, titanium oxide, iron oxide, copper oxide and mixtures thereof to form the nanoscale composite catalyst.

30. The method of claim 26, comprising combining nanoscale metal particles and/or nanoscale metal oxide particles comprising gold and nanoscale support particles comprising iron oxide to form a nanoscale composite catalyst comprising from about 0.1 to 25 wt. % gold.

31. The method of claim 26, comprising adding the nanoscale composite catalyst to the cut filler to give from about 5 mg to 200 mg of the nanoscale composite catalyst per cigarette.

32. The method of claim 26, comprising adding the nanoscale composite catalyst to the cut filler to give from about 10 mg to 100 mg of the nanoscale composite catalyst per cigarette.

33. A method of making a cigarette, comprising:

(i) incorporating a nanoscale composite catalyst in tobacco cut filler, cigarette paper and/or cigarette filter;

(ii) providing the cut filler to a cigarette making machine to form a tobacco column;

(iii) placing a paper wrapper around the tobacco column to form a tobacco rod; and (iv) attaching the cigarette filter to the tobacco rod to form the cigarette, wherein the nanoscale composite catalyst comprises nanoscale support particles and nanoscale metal particles and/or nanoscale metal oxide particles, wherein the nanoscale metal particles and/or nanoscale metal oxide particles comprise an element selected from the group consisting of B, Mg, Al, Si, Ti, Fe, Go, Ni, Zn, Ge, Zr, Nb, Mo, Ru, Rh, Pd, Ag, Sn, Hf, Ta, W, Re, Os, Ir, Pt, Au and mixtures thereof, further comprising forming the nanoscale composite catalyst by:

combining nanoscale metal and/or metal oxide particles with a colloidal solution, increasing the viscosity of the colloidal solution to form an intimate mixture of the metal and/or metal oxide nanoscale particles and the colloidal solution, and drying the mixture to form the nanoscale composite catalyst.

34. The method of claim 33, comprising combining nanoscale particles having an average particle size of less than about 7 nm with the colloidal solution.

35. The method of claim 33, comprising combining a colloidal solution having a concentration of colloids of from about 10 to 60 weight percent with the nanoscale particles.

36. The method of claim 33, wherein the increasing the viscosity of the colloidal solution comprises changing the pH of the colloidal solution.

37. The method of claim 33, wherein the increasing the viscosity of the colloidal solution comprises adding a dilute acid or a dilute base to the colloidal solution.

38. The method of claim 33, further comprising adding dilute HCl to the colloidal solution.

39. The method of claim 33, wherein the drying comprises air drying or super-critical drying.

40. The method of claim 33, further comprising washing the mixture in de-ionized water before the drying.

41. A method of making a cigarette, comprising:

(i) incorporating a nanoscale composite catalyst in tobacco cut filler, cigarette paper and/or cigarette filter;

(ii) providing the cut filler to a cigarette making machine to form a tobacco column;

(iii) placing a paper wrapper around the tobacco column to form a tobacco rod;

(iv) attaching the cigarette filter to the tobacco rod to form the cigarette, wherein the nanoscale composite catalyst comprises nanoscale support particles and nanoscale metal particles and/or nanoscale metal oxide particles, wherein the nanoscale metal particles and/or nanoscale metal oxide particles comprise an element selected from the group consisting of B, Mg, Al, Si, Ti, Fe, Co, Ni, Zn, Ge, Zr, Nb, Mo, Ru, Rh, Pd, Ag, Sn, Hf, Ta, W, Re, Os, Ir, Pt, Au and mixtures thereof, and (v) combining nanoscale metal and/or metal oxide particles and nanoscale support particles comprising an oxide selected from the group consisting of aluminum oxide, silicon oxide, titanium oxide, iron oxide, cobalt oxide, copper oxide, zirconium oxide, cerium oxide, yttrium oxide optionally doped with zirconium, manganese oxide optionally doped with palladium, and mixtures thereof to form the nanoscale composite catalyst, further comprising forming the nanoscale composite catalyst by:

combining a metal precursor and a solvent to form a metal precursor solution, combining the metal precursor solution with nanoscale support particles to form a mixture, heating the mixture to a temperature effective to thermally decompose the metal precursor into nanoscale particles, and drying the mixture.

42. The method of claim 41, comprising combining the metal precursor solution with nanoscale support particles that are in a colloidal solution.

43. The method of claim 41, comprising combining nanoscale support particles that comprise and oxide selected from the group consisting of aluminum oxide, silicon oxide, titanium oxide, iron oxide, cobalt oxide, copper oxide, zirconium oxide, cerium oxide, yttrium oxide, manganese oxide and mixtures thereof with the metal precursor solution.

44. The method of claim 41, comprising combining a metal precursor comprising a dionate, oxalate and/or a hydroxide with the solvent.

45. The method of claim 41, comprising combining a metal precursor comprising an element selected from the group consisting of B, Mg, Al, Si, Ti, Fe, Co, Ni, Zn, Ge, Zr, Nb, Mo, Ru, Rh, Pd, Ag, Sn, Hf, Ta, W, Re, Os, Ir, Pt, Au and mixtures thereof with the solvent.

46. The method of claim 41, comprising combining a solvent comprising at least one of distilled water, alcohol, aldehydes, ketones and aromatic hydrocarbons with the metal precursor.

47. The method of claim 41, wherein the mixture is heated to a temperature of from about 200 to 400° C.

48. The method of claim 41, comprising combining nanoscale support particles having an average diameter of less than about 50 nm with the metal precursor solution.

49. The method of claim 42, wherein the viscosity of the colloidal solution is increased to form a gel before heating the mixture.

50. The method of claim 49, wherein the gel is washed before heating the mixture.

51. The method of claim 42, comprising combining a colloidal solution having a concentration of colloids of from about 10 to 60 weight percent with the metal precursor solution.

52. The method of claim 42, comprising combining a metal precursor solution comprising gold with a colloidal solution comprising an oxide selected from the group consisting of silicon oxide, titanium oxide, iron oxide, copper oxide and mixtures thereof.

53. The method of claim 42, comprising combining a metal precursor solution comprising gold with a colloidal solution comprising iron oxide at a ratio of about 0.1 to 25 wt. % gold to iron oxide.

54. The method of claim 42, wherein the increasing the viscosity of the colloidal solution comprises varying the pH of the mixture.

55. The method of claim 42, wherein the step of increasing the viscosity of the colloidal solution comprises adding a dilute acid to the mixture.

56. The method of claim 55, wherein dilute HCl is added to the mixture.

57. The method of treating tobacco smoke produced by the cigarette of claim 12, comprising lighting the cigarette to form smoke and drawing the smoke through the cigarette, wherein the catalyst converts carbon monoxide to carbon dioxide.

* * * * *